United States Patent [19]

Rójey

[11] Patent Number: 4,624,305

[45] Date of Patent: Nov. 25, 1986

[54] HEAT EXCHANGER WITH STAGGERED PERFORATED PLATES

[75] Inventor: Alexandre Rójey, Garches, France

[73] Assignee: Institut Francais du Petrole, Rueil-Malmaison, France

[21] Appl. No.: 352,425

[22] Filed: Feb. 25, 1982

[30] Foreign Application Priority Data

Feb. 25, 1981 [FR] France ..... 8103902

[51] Int. Cl.[4] ..... F28F 7/00

[52] U.S. Cl. ..... 165/165; 165/166

[58] Field of Search ..... 165/164, 165, 179, 166

[56] References Cited

U.S. PATENT DOCUMENTS

| | | | |
|---|---|---|---|
| 1,863,586 | 6/1932 | Wilke | 165/166 |
| 2,656,159 | 10/1953 | Holm et al. | 165/166 |
| 3,198,248 | 8/1965 | Stack | 165/166 |
| 3,552,488 | 1/1971 | Grill | 165/166 |
| 3,757,856 | 9/1973 | Kun | 165/166 |
| 4,016,928 | 4/1977 | Bartels | 165/154 |
| 4,368,779 | 1/1983 | Rojey et al. | 165/165 |

FOREIGN PATENT DOCUMENTS

| | | | |
|---|---|---|---|
| 2700220 | 7/1978 | Fed. Rep. of Germany | 165/166 |
| 604464 | 7/1948 | United Kingdom | 165/166 |
| 857707 | 1/1961 | United Kingdom | 165/179 |
| 168734 | 7/1965 | U.S.S.R. | 165/165 |
| 661227 | 5/1979 | U.S.S.R. | 165/165 |

*Primary Examiner*—William R. Cline
*Assistant Examiner*—John K. Ford
*Attorney, Agent, or Firm*—Millen & White

[57] ABSTRACT

The heat exchanger consisting of a stack, forms a right prism, of polygonal plates with perforations of elongate shape. The rows of perforations are stacked and each perforation of a plate communicates with two perforations of the following plate, thereby forming series of independent networks of interconnected perforations. Two systems of networks are thus provided, each of which is used to circulate a fluid. Supply and discharge means are also provided for each of the fluids.

11 Claims, 16 Drawing Figures

HEAT EXCHANGER WITH STAGGERED PERFORATED PLATES

BACKGROUND OF THE INVENTION

The invention relates to a compact heat exchange device of low cost, for use in heat exchanges involving several fluids, such as gases.

The exchange surface, per volume unit, of the tube-and-sheet exchangers, which are frequently used, is limited by the difficulty of reducing the diameter of the tubes and the distance between the tubes below a value of about 1 cm.

The plate exchangers provide larger specific exchange surfaces. In these exchangers, the fluids taking part in the exchange circulate on both sides of the plates, but the specific surface is also limited by the need to maintain a sufficient distance between the plates.

It has already been proposed to build a compact exchanger at low cost by stacking perforated plates so as to obtain channels, by superposition of the perforations, through some of which is passed one of the fluids taking part to the exchange while another fluid taking part in the exchange is passed through others, and with the heat being transferred between the fluids circulating in the channels by conduction through the material forming at least one part of said plates. The plates are then preferably made of a metallic material having good heat conductivity.

An embodiment of this type is described in U.S. patent application Ser. No. 145,651 filed on the May 2, 1980, now U.S. Pat. No. 4,368,779 issued Jan. 18, 1983, and assigned to the same Assignee as the instant application. It is illustrated by FIGS. 1A and 1B of the accompanying drawings.

In this device, the heat exchange takes place between a fluid A, and a fluid B at a different temperature from A, which pass through distinct groups of channels, for example, according to the arrangement of FIG. 1B (showing, in cross-section, the plates stacking), in such manner that each channel wherethrough is passed one of the fluids is adjacent to at least one channel wherethrough is passed the other fluid. The channels are designated by the arrows *2a* to *2g* of FIG. 1A, showing, a cross-section, of the exchanger along the plane A—A of the FIG. 1B.

This arrangement has the advantage of permitting a counter-current heat exchange between fluids A and B. However the problem is posed of supplying each of the fluids to each end of the apparatus. It is then necessary to provide each end of the device with at least one distributing plate comprising grooves overlapping the channels wherein circulates the fluid which is fed or discharged through said grooves. It is accordingly difficult to solve the problems relating to the construction of the units and to pressure drops, when distributing a gaseous fluid. In that case, as a matter of fact, in order to limit the pressure drop, the inlet and oulet cross-sectional areas must be approximately the same as the passage section used for the exchange.

SUMMARY

The invention proposes a new heat exchange device with superposed perforated plates providing a large exchange surface per unit volume, while avoiding the above-mentioned difficulties, as concerns chiefly the distribution of the fluids taking part in the exchange.

The heat exchange device with perforated plates according to the invention may be defined, in general terms, as comprising a specified zone for heat exchange wherethrough circulate the different fluids taking part in the exchange, as well as, for each of these fluids, feed and discharge means connected to the exchange zone.

DETAILED DESCRIPTION

Figure 1A:
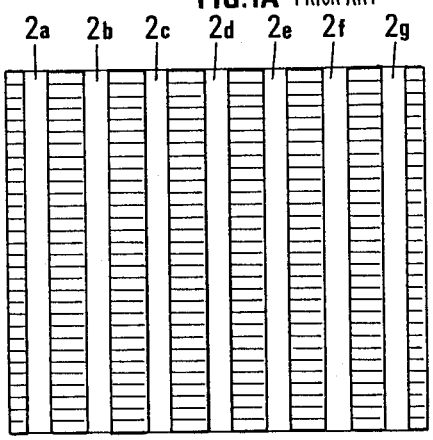
FIG.1A PRIOR ART
FIGS. 1A and 1B are comparative heat exchanger structures, as discussed, supra, in relationship to U.S. Pat. No. 4,368,779.
Figure 2A:
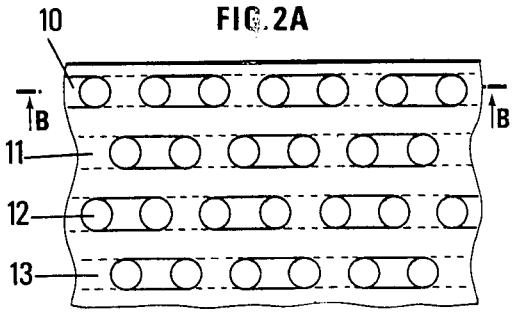
FIG. 2A is a plan view of a part of a stack of plates wherein the perforations are of the same size and spaced regularly along the rows of each plate.
Figure 2B:
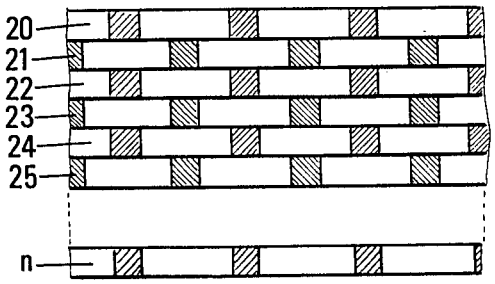
FIG. 2B is a cross-section across B—B of FIG. 2A.
Figure 1B:
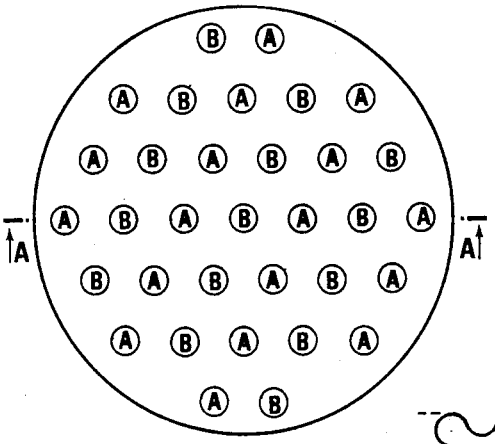
FIG.1B PRIOR ART

The exchange zone, properly said, of the device of the invention consists essentially of a stack (forming a right prism) of polygonal plates having preferably at least two sides parallel to each other (for example rectangular plates), these plates being provided with elongate perforations in parallel rows, said perforations being arranged and said plates stacked in such a manner that the perforations rows are superposed from plate to plate and, at least for a part of said plates and said rows, each perforation of at least one portion of the rows of an intermediate plate of the stack communicates with two perforations of the corresponding row of the preceding plate and with two perforations of the corresponding row of the following plate. The simplest way to obtain this result is to provide the perforations all of the same size, to space them regularly along the rows of each plate and to select the distance between the adjacent ends of two adjacent perforations belonging to a same row to be less than the length of said perforations. This is shown in FIGS. 2A and 2B, respectively as a plan view and a cross-sectional view of a part of the stack of plates forming the exchange zone. More precisely, the section of FIG. 2B shows an alternate staggering of the perforations of successive plates, the perforations of the plates 20, 22 and 24, which form a first group of plates, being superposed to each other (in a plan view), as well as the perforations of plates 21, 23 and 25 which form a second group of plates, with the perforations of the second group of plates being staggered with respect to the perforations of the first group, so as to permit the partial overlapping between a perforation of a plate belonging to one of the groups and two perforations of each adjacent plate belonging to the other group.

As a rule, the arrangement of the perforations on each plate and the manner of superposing the plates results in the formation of a series of interconnected perforations networks, each network having no communication with the adjacent network(s).

The network system so-formed is divided into as many distinct sub-systems as the number of fluids taking part in the exchange, in such a manner that each network of perforations wherethrough is passed one of the fluids taking part in the exchange is adjacent to one or two other networks of perforations wherethrough is passed another fluid taking part in the exchange. Thus, for example, when the exchanger formed of plates such as shown in FIGS. 2A and 2B is used to exchange heat between two fluids, the perforations of the rows 10 and 12 are fed with a first fluid and the perforations of the rows 11 and 13 with another fluid.

Thus, the arrangement of the perforations on each plate and the way to superpose the plates, which create a network of interconnected perforations, allows the supply and the discharge of each of the fluids taking part in the exchange through a duct connected to any portion of one of the stack sides, the junction sections of the different ducts being completely distinct. As a matter of fact, all the perforations of the same network are then fed with the corresponding fluid, even through said fluid is supplied to a portion only of the considered side. Similarly, the fluid circulating through said network of interconnected perforations can be discharged to a portion only of another side, for example, the opposite side, as explained more in detail hereinafter. Conversely, when channels are formed by stacking of plates with superposed perforations, as in the prior art, each channel opening on plates located at the end of the stack must communicate with the supply and discharge ducts, which necessitates more complex distribution systems, since each fluid must be distributed over the same total section and not over distinct portions of the section.

More particularly, the ducts for feeding (inlet) or discharging (outlet) each of the fluids taking part in the heat exchange are connected to distinct sides of the plate stacking, so that the section of junction of each duct with the considered side covers at least a part of all of the perforation network to be traversed by the corresponding fluid and opening on said side, the networks or network portions coming to a junction section of a duct and which have to be traversed by the fluid circulating in said duct being open on said section, the other networks or the other network portions coming to said junction section being closed, and all the junction sections being separated from each other and the networks or network portions coming to the faces of the stack outside of the junction sections being all closed.

The practical arrangement of the heat exchange devices of the invention is described hereinafter in greater detail.

In the most frequent case, the perforated plates have a rectangular shape and the exchange zone is a rectangular parallelepiped. Each network of interconnected perforations may then open on two plates located at the ends of the stack, along a row of perforations of each of the said plates and on the two sides perpendicular to the direction of the perforation rows, through openings corresponding to the intersections of the superposed perforation rows with each of said sides.

The exchange zone can be made up of a few tens to a few hundreds of plates having a thickness typically ranging from about 1 mm to 1 cm, or more.

All the plates making up the exchange zone may have the same thickness or different thicknesses. A simple way to introduce plates of different thickness into the stack, if desired, consists of introducing, instead of a given single plate, two or more plates whose perforations are superposed, and of alternating this system with two or more plates whose perforations are also superposed but staggered with respect to the perforations of the preceding plate system. Thus, in the present invention, plate is intended to mean either a single plate or a system of several plates, (however, in small number), whose perforations are superposed without staggering.

On the other hand, each plate may comprise several tens to several hundreds of parallel rows of perforations. These rows are preferably equidistant.

The perforations may have various shapes. They may have a rectangular shape according to the sketch of FIG. 3A. Round ends, as in the sketch of FIG. 2A, are preferred since sharp edges are subject to local deformations or even sometimes to tears of the plates during perforation.

Figure 3B:
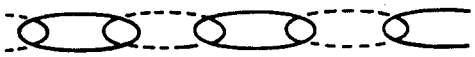
FIGS. 3A, 3B, 3C and 3D show different perforation shapes.

The perforations may also be oval, of substantially elliptic shape, as the sketch of FIG. 3B.

Figure 3C:
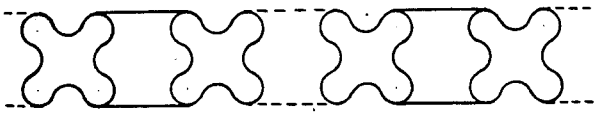
Figure 3A:
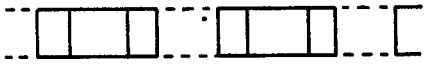
Figure 3D:
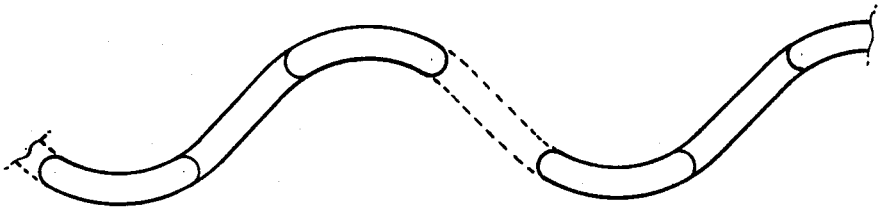

More complex shapes may also be used to increase the exchange area, as for example those shown in FIGS. 3C and 3D.

As a rule, any shape can be used, provided the maximum length of a perforation in the direction of a row of perforations traversed by a same fluid is greater than the minimum distance between the adjacent ends of two adjacent perforations, so as to ensure, when superposing the plates, the partial overlapping of two perforations of a plate with a perforation of the next adjacent upper plate.

An elongate shape of the perforations is preferred in order to ensure a better overlapping, and the maximum length of a perforation in the direction of a row is preferably at least two times the maximum width of the perforations in a perpendicular direction. In addition, the maximum length of the perforations is usefully lower than 10 times their maximum width. Normally, the length of the perforations may range from, for example, 3 to 100 mm.

The plates must conduct heat and are preferably made of metal, for example, ordinary steel, stainless steel, aluminum, copper, Monel metal, titanium or any other heat-conducting material. If the heat exchange is effected at high temperature, a refractory material, of lower heat conductivity than the above materials, can be used, such as ceramics. A composite material may also be used.

The plates forming the exchange zone can be perforated by different methods: mechanical, chemical or electrochemical. The use of perforated plates for the exchange zone with the exclusion of plates having openings of another type, such as, for example, slots or grids, is advantageous since the perforated plates can be made in a simple and economical manner, for example by punching, and have a fairly good mechanical strength. Besides, the use of plates all of which have the same perforations makes the construction problems easier.

The plates can be maintained and attached to each other by the different techniques known to maintain sufficient adherence of the plates to each other. For example, they can be stuck by means of a fluid glue such as an epoxy adhesive, or sealed with a hot coating, or even brazed.

In a number of cases, it is desirable to have the exchanger disassembled, so as to clean or optionally replace certain plates. In that case, the plates are not maintained adherent to each other and are merely stacked.

When a thorough tightness is not required, the tightness between the rows of perforations traversed by different fluids can be maintained by more tightening of the plates. This tightness can be improved by inserting, between the plates, joints made of a deformable material.

A number of particular methods for using the heat exchange device of the invention are described hereinafter.

Figure 4A:
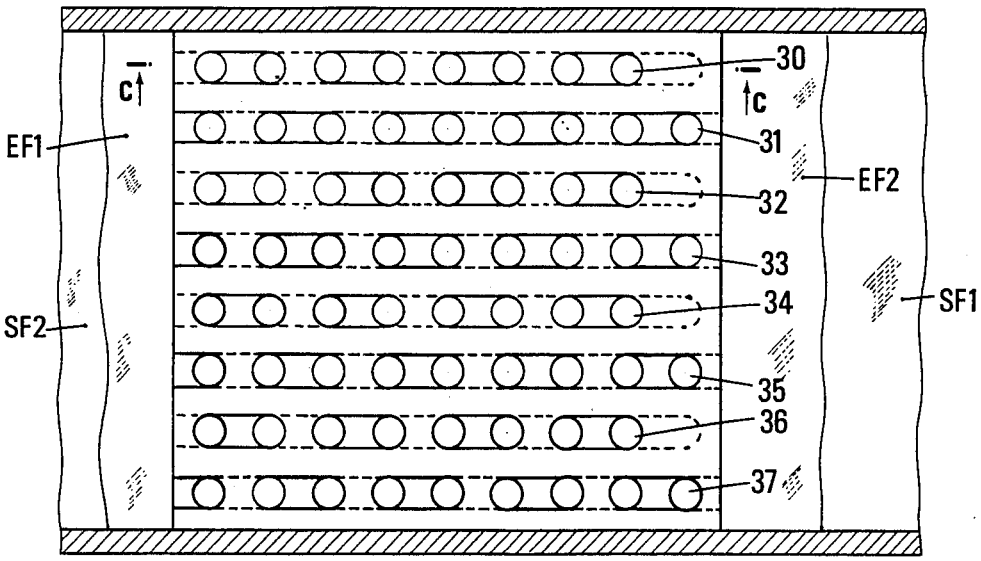
FIG. 4A represents a cross-sectional view of the exchanger, the end plate PE being removed.
Figure 4B:
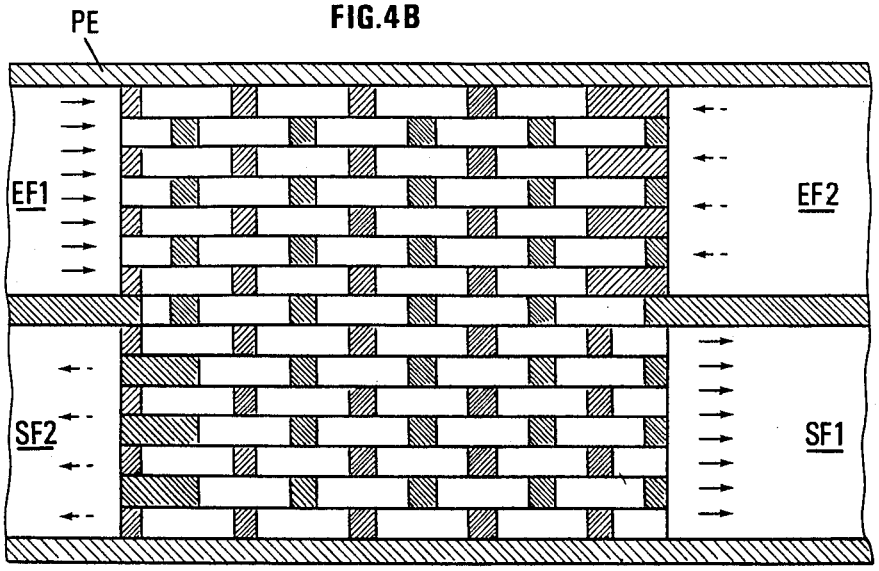
FIG. 4B represents a cross-section of the exchanger along the plan C—C.

A first example of the manner of effecting the supply and the discharge of the two fluids participating in the exchange is shown in the sketches of FIGS. 4A and 4B.

The exchanger can be used to effect an exchange between a first fluid (fluid 1) circulating in the networks 30, 32, 34 and 36 and a second fluid (fluid 2) circulating in the networks 31, 33, 35 and 37.

The section shown in FIG. 4B is across the network 30 fed with fluid 1. This fluid 1 is supplied through duct EF1, traverses the whole network of interconnected perforations and is discharged through duct SF1. For that reason, the plates of the network 30 and of the other networks of even reference number must be closed with respect to duct EF2 supplying fluid 2 and to duct SF2 discharging fluid 2. Conversely the networks 31, 33, 35 and 37 are open to duct EF2 supplying fluid 2 and to duct SF2 discharging fluid 2 and closed with respect to duct EF1 supplying fluid 1 and to duct SF1 discharging fluid 1.

In the case shown in FIGS. 4A and 4B, the two fluids are supplied and discharged through two faces perpendicular to the plates.

It is also possible to supply one of the fluids through one of the sides perpendicular to the plates, to discharge it from the opposite side and to supply the other fluid through a plate located at one end of the stack and to withdraw it from the opposite side.

Figure 5A:
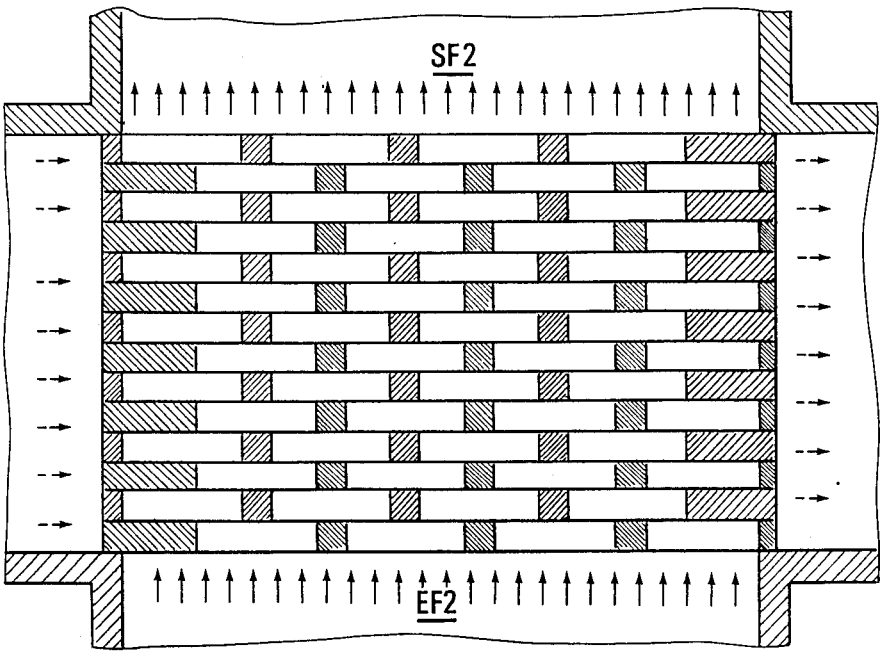
FIGS. 5A and 5B are cross-sections of an exchanger wherein one of the fluids is supplied in a direction perpendicular to the plates and discharged from the opposite side with the other fluid supplied through a plate located at one end of the stack and withdrawn from the opposite side.
Figure 5B:
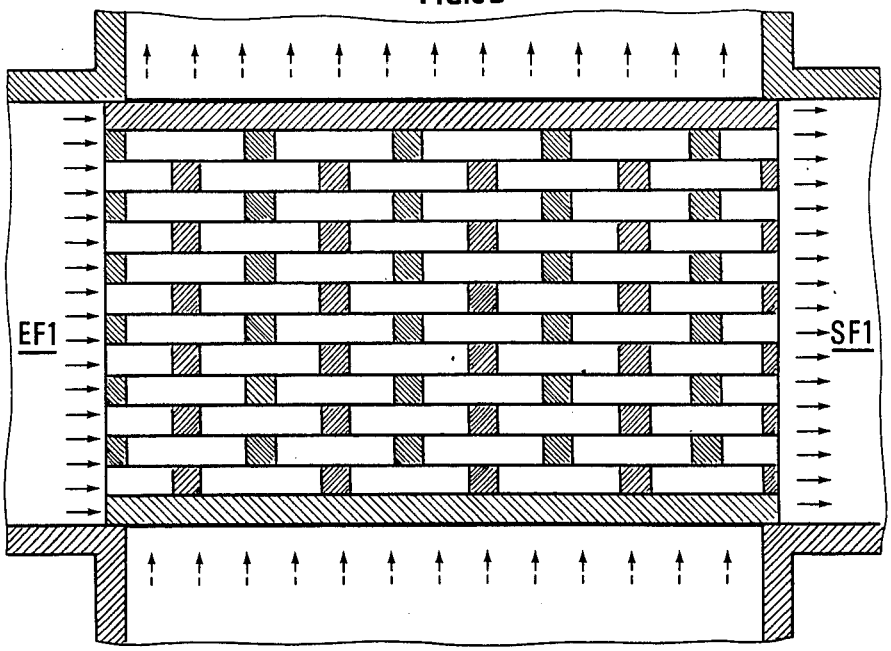

This arrangement is shown in FIGS. 5A and 5B. One of the fluids taking part in the exchange is fed through duct EF2 and discharged through duct SF2. The perforation networks corresponding to the passage of this fluid are open to the feed section of duct EF2 and to the discharge section of duct SF2 (FIG. 5A). The perforation networks corresponding to the passage of the fluid fed from duct EF1 and discharged through duct SF1 are closed to the feed section of duct EF2 and to the discharge section of duct SF2 (FIG. 5B).

Other arrangements conforming to the basic principle of the exchanger of the invention can be conceived.

Figure 6A:
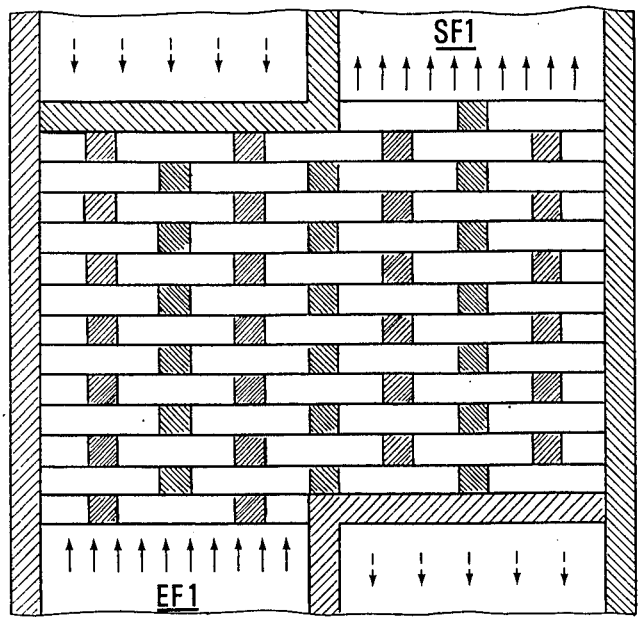
FIGS. 6A and 6B are cross-sections showing arrangements whereby counter-current flow is possible.
Figure 6B:
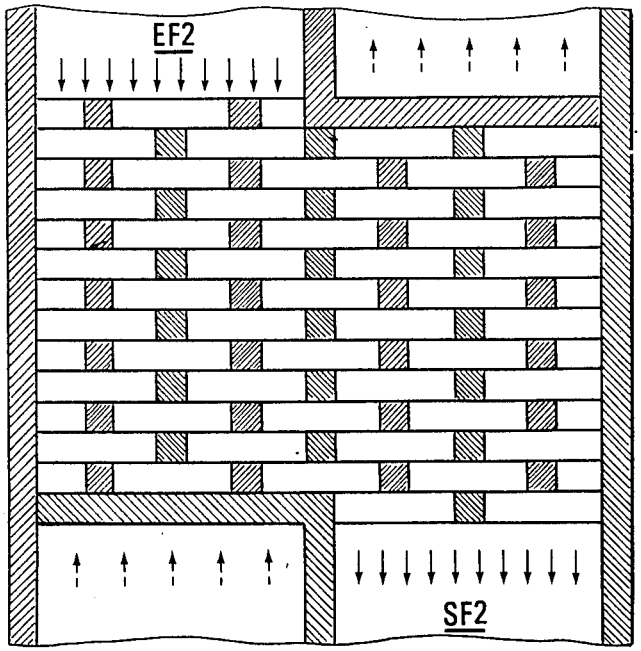

Thus, each duct EF1, EF2, SF1 or SF2 may open on a portion only of the total surface of the corresponding side of the stack. It is possible, for example, supposing the plates of the stack are horizontal, to connect duct $EF_2$ through a section joined to the upper part of the stack and to connect duct $SF_2$ through a section joined to the lower part of the stack, as shown in FIGS. 6A and 6B. This provides for a counter-current effect in the heat exchange between the two fluids taking part to the exchange.

Figure 7A:
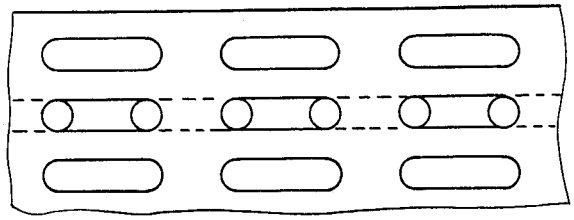
FIGS. 7A and 7B are plan views showing an arrangement wherein perforated plates having aligned perforations are alternated with perforated plates having staggered perforations.
Figure 7B:
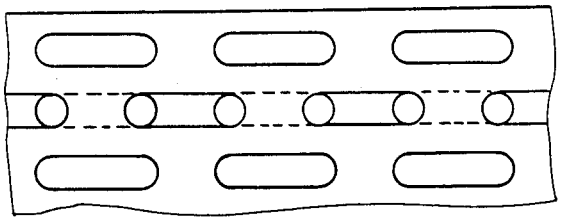

It is also possible to circulate one of the fluids through networks of interconnected perforations, according to the basic principle given above, by connecting the input and output sections for this fluid to sides perpendicular to the stack, while the other fluid is circulated in non-communicating channels obtained by superposing perforations, said channels opening at the end plates of the stack on the input and output ducts for the fluid circulated in said channels. This can be obtained, for example, by alternating, in the stack, perforated plates having aligned perforations with perforated plates having staggered perforations, as shown in FIGS. 7A and 7B.

An intermediate part of the stack of plates distinct from the distribution zones for the fluids may also be assigned to the circulation of at least one of the two fluids through rows of non-communicating channels.

The exchanger conforming to the invention can be used to perform heat exchanges between quite different phases.

It is particularly well adapted to gas-gas exchanges which necessitate large exchange surfaces since the gases have relatively low transfer coefficients. It can be used, for example, to recover heat from air extracted from a room. It can also be used to recover heat contained in the flue gas from a boiler or a furnace, for example, by preheating the combustion air. If the plates are merely stacked, in case of gas leakage, it is generally advantageous that this leakage occurs from the fresh air towards the flue gas, which can contribute to reduce the fouling by the soot contained in the flue gas.

The exchanger of the invention can also be used with liquid phases and in the case of a phase change. In the latter case, several types of surface, favorable to the condensation or to the vaporization, can be used at the periphery of the perforations.

The exchanger of the invention can be used in a wide temperature range. It can be used either at relatively high temperatures or conversely, at low temperatures, such as those prevailing in the refrigeration processes.

What is claimed is:

1. A device for exchanging heat between at least two fluids at different temperatures, the device comprising a heat exchange zone and, for each of said fluids, supply and discharge means interfacing with said heat exchange zone, said device being characterized in that said heat exchange zone consists of a stack of rectangular plates having perforations of elongate shape arranged in rows extending parallel to one another and parallel to one pair of opposite edges of said rectangular plates, said stack having opposed surfaces with first continuous face surfaces and second continuous face surfaces and means for demarking between the first and second continuous face surfaces, said elongate perforations being of substantially the same size, being of identical shape and being regularly spaced along the rows of each of said plates with a distance between the adjacent ends of two adjacent perforations of the same row being less than the length of said perforations, the perforations being arranged on the respective plates with said plates stacked with each row of perforations superimposed upon a row of an adjacent plate, such that each perforation in a row of an intermediate plate disposed between two adjacent plates communicates with two perforations of the corresponding row of each of the adjacent plates, thus forming at least first and second separate networks of interconnecting rows of perforations said rows in said separate networks having no communication with one another within said heat exchanger; each of the first and second separate networks being used to circulate one of the fluids participating in the exchange, with the network of perforations for circulating one of the fluids being adjacent to the paths of the network circulating the other fluid; the first of said networks used to circulate the first fluid having a plurality of perforations opening only at the first continuous faces of the stack; the second of said networks used to circulate the second fluid having a plurality of perforations opening only at the second continuous faces of the stack; means for blocking opening of the perforations of the second network at the first continuous faces and means for blocking opening of the perforations of the first network at the second continuous faces, the supply and discharge means interfacing with the heat exchange zone including first inlet and outlet duct means each having a continuous opening, the duct means being only in open communication with a plurality of rows of perforations in the first continuous faces for transporting the first fluid to and from the first continuous faces; the supply and discharge means further including second inlet and outlet duct means each having a continuous opening, the second duct means being only in open communication with a plurality of rows of perforations in the second continuous faces for transporting the second fluid to and from the second continuous faces.

2. The device according to claim 1 wherein there is communication of at least some perforations of at least some rows of at least some intermediate plates with two perforations of the corresponding rows of adjacent plates by staggering said perforations.

3. A device according to claim 2 comprising a few tens to a few hundreds of plates.

4. A device according to claim 2 comprising at least 14 plates having superposed overlapping perforations.

5. A device according to claim 2 wherein the length of each perforation is about 3 to 100 mm.

6. A device according to claim 2 wherein each row of an intermediate plate contains at least four perforations.

7. A device according to claim 5 wherein each row of an intermediate plate contains at least four perforations.

8. The device according to claim 2 wherein the first continuous faces are parallel to one another, and the second continuous faces are parallel to one another but perpendicular to the first continuous faces, and wherein the first inlet and outlet duct means extend perpendicularly from the continuous faces with which the duct means interface.

9. The device of claim 2 wherein the first faces and second faces extend parallel with respect to one another on the same surfaces of the stack, with the first inlet duct means being parallel to the second outlet duct means while being interfaced with the same surface of the stack, while communicating with their respective faces and while being isolated from one another; and with the second inlet duct means being parallel to the first outlet duct means, while being interfaced with an opposite surface of the stack, while communicating with their respective faces and while being isolated from one another.

10. The device of claim 9 wherein the flow of fluid at the interfaces of the duct means with the stack is substantially parallel to the plates constituting the stack, with the rows of perforations in the outer plates being blocked by blocking means extending parallel to the plates constituting the stack for keeping the fluids within the stack.

11. The device of claim 9 wherein the flow of fluid at the interfaces of the duct means with the stack is substantially perpendicular to the plates constituting the stack, with the perforations at surfaces of the stack extending perpendicular to the plates constituting the stack being blocked by blocking means to keep the fluids within the stack.

* * * * *